US007762331B2

(12) United States Patent
Goodman et al.

(10) Patent No.: US 7,762,331 B2
(45) Date of Patent: Jul. 27, 2010

(54) PROCESS FOR ASSEMBLING A LOADING TUBE

(75) Inventors: Kenneth Goodman, Sugar Land, TX (US); Michael Bertoja, Pearland, TX (US); Luis Ochoa, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 231 days.

(21) Appl. No.: 11/614,193

(22) Filed: Dec. 21, 2006

(65) Prior Publication Data

US 2008/0149338 A1 Jun. 26, 2008

(51) Int. Cl.
*E21B 29/02* (2006.01)

(52) U.S. Cl. ..... 166/299; 89/1.15; 102/202.1; 102/202.7

(58) Field of Classification Search ..... 166/297, 166/299, 55; 89/1.15, 1.151; 102/202.1, 102/202.2, 202.7, 202.12, 312, 313
See application file for complete search history.

(56) References Cited

U.S. PATENT DOCUMENTS 2,742,857 A * 4/1956 Turechek ..... 102/310
2,918,001 A * 12/1959 Alford ..... 102/202.2
2,953,971 A * 9/1960 Porter ..... 175/4.58
4,566,544 A 1/1986 Bagley
5,088,413 A 2/1992 Huber
5,505,134 A * 4/1996 Brooks et al. ..... 102/202.7
5,700,969 A * 12/1997 Mosley ..... 102/313
7,387,162 B2 * 6/2008 Mooney et al. ..... 166/297
2004/0216632 A1 11/2004 Finsterwald

FOREIGN PATENT DOCUMENTS

EP 000075520 A2 * 3/1993
EP 0601880 A2 6/1994
WO 9503521 A1 2/1995

* cited by examiner

*Primary Examiner*—Kenneth Thompson
(74) *Attorney, Agent, or Firm*—Kevin B. McGoff; Rodney V. Warfford; Trop, Pruner & Hu, P.C.

(57) ABSTRACT

A process is disclosed for assembling a loading tube for a perforating gun for use in a perforating system. At a first location, e.g., a shop, which is not the location at which perforating operations will be conducted, the loading tube is completely assembled. The completely assembled loading tubing is then transported to a second location where perforating operations are to be conducted. In one embodiment, an RF-safe initiator, wiring, a detonating cord and a plurality of shaped charges are installed into the loading tube at a first location. The RF-safe initiators may comprise an exploding foil initiator or an exploding bridge wire. A process for assembling a loading tube for a single-shot perforating gun is also disclosed.

3 Claims, 5 Drawing Sheets

PROCESS FOR ASSEMBLING A LOADING TUBE

BACKGROUND OF THE INVENTION

1. Field of the Invention

The present invention generally relates to perforating apparatus, and, more particularly, to a loading tube for use in a perforating system.

2. Description of the Prior Art

For purposes of enhancing production from a subterranean formation, a perforating gun typically is lowered down into a wellbore that extends through the formation. A perforating gun may, for example, comprise a plurality of radially-oriented shaped charges which are detonated to form perforations in the formation proximate the wellbore. The shaped charges may, for example, be placed at points along a helical spiral that extends around a longitudinal axis of the perforating gun.

Current gun systems use separate components for the pressure bulkhead, detonator, charge holder, detonation cord and wiring to the guns below. When a gun is built, all the pieces are assembled together except the detonator and shipped to the location where the perforating operation is to be conducted. At that location, the gun is opened and the detonator is installed. The detonator may, for example, be an RF-safe detonator provided by the assignee of the present application, and this detonator may include an addressable switch, a fireset and an initiator. Accordingly, the installation of the detonator assembly at the site where perforating is to take place involves the connection of a number of wires in a very small space.

SUMMARY OF THE INVENTION

In accordance with the present invention, a process is provided for assembling a loading tube for a perforating gun for use in a perforating system. A process in accordance with the present invention comprises installing an RF-safe initiator and wiring into the loading tube at a first location which is not the site at which the perforating operation will be conducted. In some embodiments, the RF-safe initiator comprises an electronics board including an addressable switch, a fireset, and either an exploding foil initiator or an exploding bridge wire. A process in accordance with the present invention also comprises the step of installing a detonating cord and shaped charges into the loading tube at said first location. If needed, a pressure bulkhead is connected to one end of the loading tube such that one or more loading tubes—including the pressure bulkheads—may be inserted into carriers to form a perforating string. Once that assembly is complete, a process in accordance with the present invention comprises transporting the perforating string to a second location which is the site where perforating operations are to be conducted.

In accordance with the present invention, a perforating apparatus is provided which comprises a loading tube with connectors at its respective ends and a plurality of receptacles for receiving shaped charges, a detonating cord, wiring and an RF-safe initiator. An RF-safe initiator, wiring, shaped charges and a detonating cord are installed in the loading tube at a first location which is not the site where perforating operations are to be conducted. If needed, for example in selective-fire gun systems, a pressure bulkhead is connected to one end of the loading tube for connection with other such loading tubes and insertion into a gun carrier to form a pre-assembled and pre-armed perforating gun string. The pre-assembled and pre-armed perforating gun string is transported to the second location for deployment downhole.

DESCRIPTION OF THE SPECIFIC EMBODIMENTS

Figure 1:
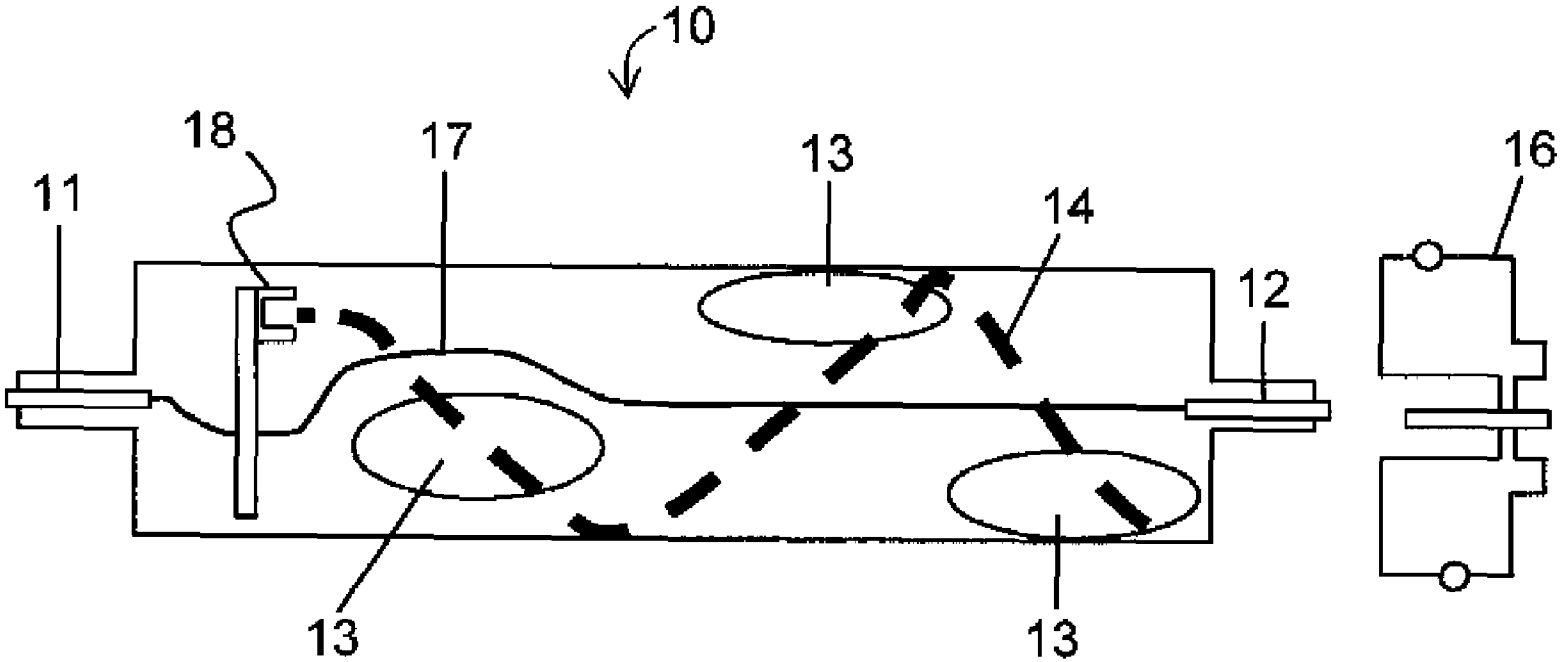
FIG. 1 is a pictorial diagram in partial cross-section of a loading tube in accordance with the present invention.

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In general, the present invention regards improved perforating gun apparatuses and processes of manufacture and use for RF-safe gun systems. As used herein, the term "RF-safe" means that the initiator of the gun system is designed to be substantially immune to typical levels of electrostatic discharge, RF radiation, and/or accidental or unintended applications of power. Moreover, various embodiments of the perforating gun apparatus and processes of manufacture and use are described with respect to selective fire (e.g., wherein the RF-safe initiator includes an addressable switch). It is intended, however, that other embodiments of the present invention include improved perforating gun apparatuses and processes of manufacture and use for non-selective fire gun systems (e.g., wherein the RF-safe initiator does not include an addressable switch).

A perforating gun comprising a loading tube in accordance with the present invention has certain advantages over the prior art. First, a perforating gun comprising a loading tube according to the present invention can be pre-armed at a first location such as a shop and then may be shipped to the field. Prior to the present invention, arming of the perforating gun occurred in the field at the well site, because non-secure detonation devices could mistakenly be connected and to avoid explosive regulatory concerns. With the present invention such mistakes are avoided. Second, it is more efficient to pre-arm the perforating gun in a shop location, as opposed to arming at the location where perforating is to be conducted and where rig time and operating time is costly.

In general, the assembly of the loading tube at a first location comprises installing shaped charges and a detonation cord into the loading tube. An RF-safe initiator is also installed into the loading tube, along with wiring. An embodiment of the RF-safe initiator comprises an electronics board including an addressable switch, fireset and either an exploding foil initiator or an exploding bridge wire. An addressable switch comprises a circuit facilitating selection (e.g., from a surface location) of a particular perforating gun in a string of perforating guns. The loading tube may then be installed in a carrier of a perforating string and shipped to a field location for deployment downhole. The carrier may be a tubular housing within which the loading tube is installed. In other embodiments, the electronics board comprises an integrated RF-safe initiator without an addressable switch.

With reference to FIG. 1, there is illustrated an embodiment of a loading tube 10 in accordance with the present invention. Loading tube 10 may, for example, be fabricated by a molding process and comprises a receptacle 18 for receiving an initiator, receptacles 13 for receiving shaped charges, and a receptacle 14 for receiving a detonating cord. Loading tube 10 also comprises connectors 11 and 12 at its respective ends and a receptacle 17 for receiving wiring.

Figure 2:
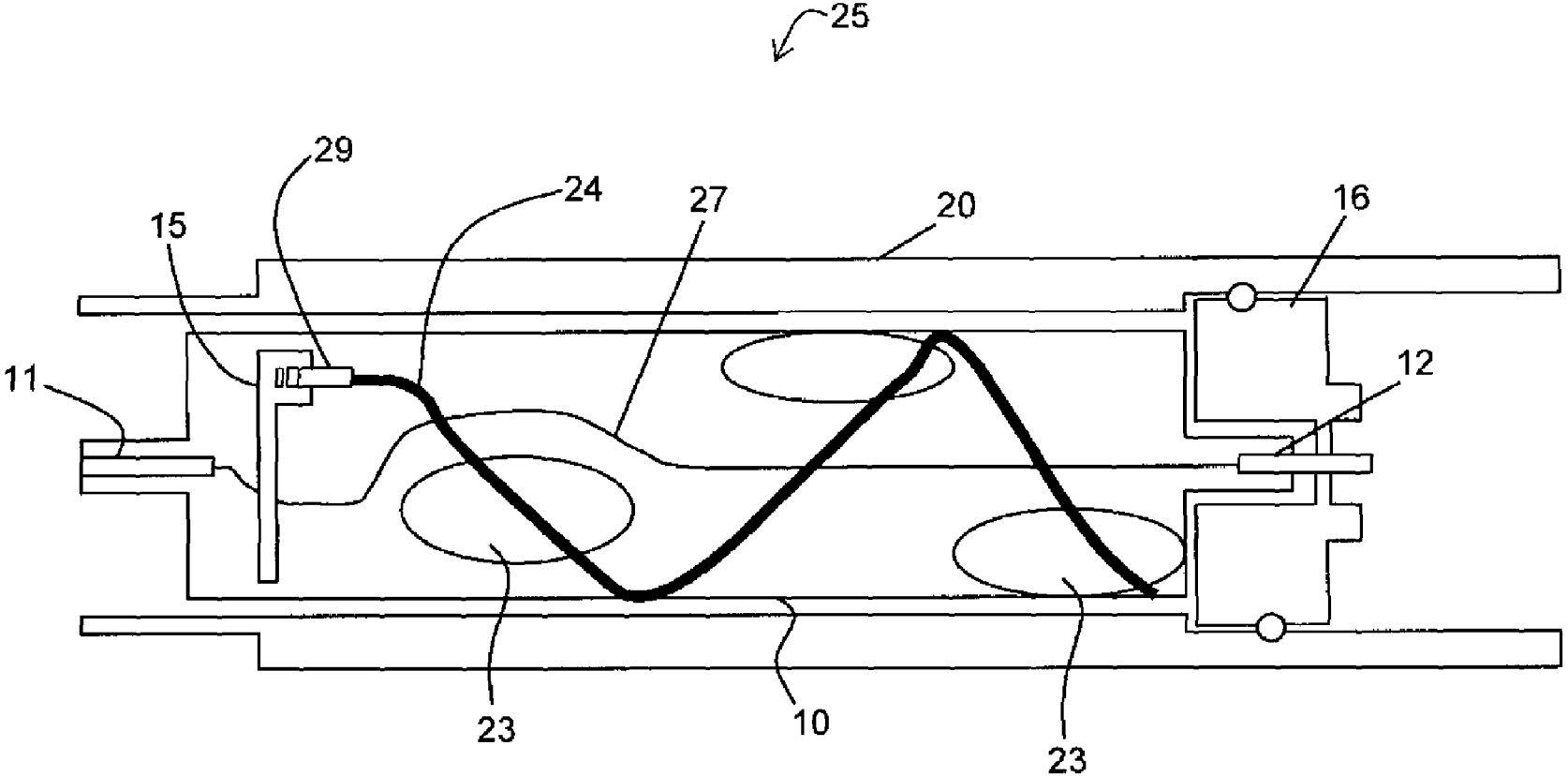
FIG. 2 is a pictorial diagram in partial cross-section of a perforating gun in which a loading tube in accordance with the present invention is installed.

At a first location (e.g., a shop or manufacturing or assembly facility) that is not the well site, detonating cord 24 and shaped charges 23 may be installed in the loading tube 10, as illustrated in FIG. 2. RF-safe initiator 15 is also installed in a receptacle in loading tube 10. In some embodiments, the RF-safe initiator 15 comprises an electronics board, an addressable switch and either an exploding foil initiator or an exploding bridge wire. In other embodiments, the RF-safe initiator 15 comprises an electronics board and either an exploding foil initiator or an exploding bridge wire without an addressable switch. A booster 29 is connected between RF-initiator 15 and the detonating cord 24. Wiring 27 is disposed in receptacle 17 (FIG. 1) and provides a connection between connectors 11 and 12 and to RF-safe initiator 15.

Figure 3:
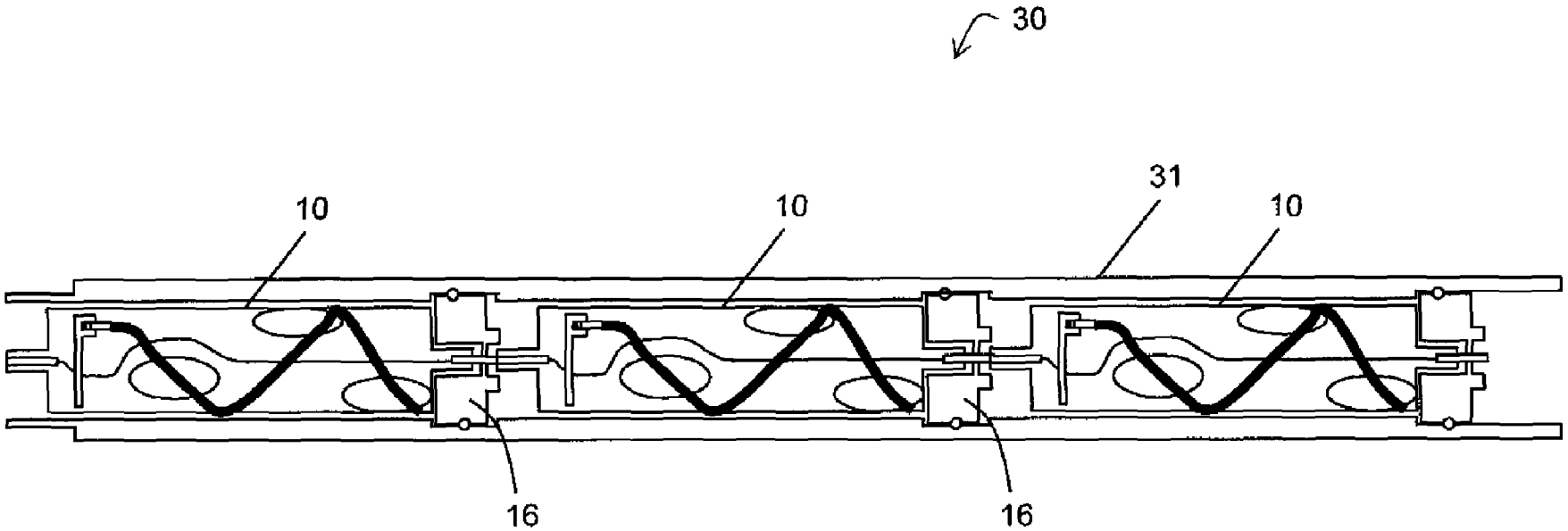
FIG. 3 is a pictorial diagram in partial cross-section of a perforating string composed of perforating gun apparatus in accordance with the present invention.

With reference to FIGS. 2 and 3, a pressure bulkhead 16 is connected to one end of loading tube 10, and the pressure bulkhead 16 engages connector 12. The pressure bulkhead 16 between perforating guns in the string provides a path for electrical continuity between the earth's surface and the guns in the string and isolates each loading tube assembly from fluids (e.g., wellbore fluids) transported by adjacent loading tube assemblies.

With reference now to FIG. 3, a perforating string 30 in accordance with some embodiments of the present invention is provided by installing a plurality of loading tubes 10 and pressure bulkheads 16 into carrier 31. Each perforating gun 10 in FIG. 3 is formed in accordance with the preceding description. Equipment at the earth's surface (not shown) selects a loading tube for detonation by addressing the addressable switch in a loading tube and by providing signals to activate the fireset in the selected loading tube. This results in the initiation of the exploding foil initiator or exploding bridge wire in the RF-safe initiator 15 and the detonation of the shaped charges in the selected loading tube. The number of loading tubes 10 in the perforating string 30 will be determined by the particular application.

After assembly, the perforating string 30 may then be transported from the first location to a second location which is the site where perforating operations are to be conducted.

Figure 4:
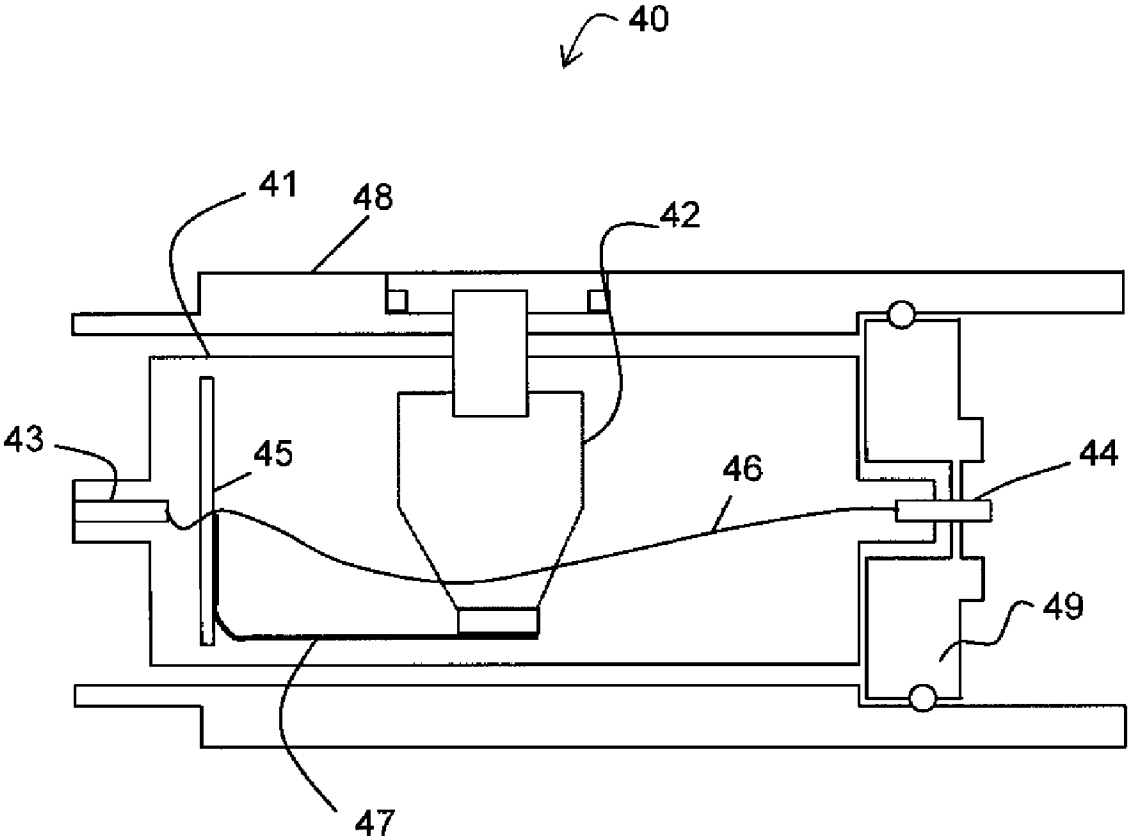
FIG. 4 is a pictorial diagram in partial cross-section of a single shot perforating gun in accordance with the present invention.

With reference now to FIG. 4, there is illustrated an embodiment of a single-shot perforating gun 40 in accordance with the present invention. Perforating gun 40 comprises loading tube 41 which is formed with a receptacle to receive shaped charge 42, a receptacle to receive wiring 46, and a receptacle to RF-safe initiator 45. At a first location, shaped charge 42 is installed in loading tube 41. RF-safe initiator is also installed in the loading tube at the first location, and RF-safe initiator 45 may comprise an exploding foil initiator which is designated 47 in FIG. 4. Alternatively, device 47 may comprise an exploding bridge wire or other RF-safe initiator. Wiring 46 interconnects the connectors 43 and 44 at the respective ends of loading tube 41 and is also operatively connected to RF-safe initiator 45 to provide a communication link between equipment at the earth's surface and RF-safe initiator 45.

After the RF-safe initiator 45, wiring 46 and shaped charge 42 are installed at a first location, the loading tube 41 may be inserted into a gun carrier and transported from that first location to a second location where perforating is to be performed. In this single-shot embodiment, the exploding foil initiator or exploding bridge wire 47 in the RF-safe initiator 45 is operatively connected to the primer end of shaped charge 42.

Figure 5:
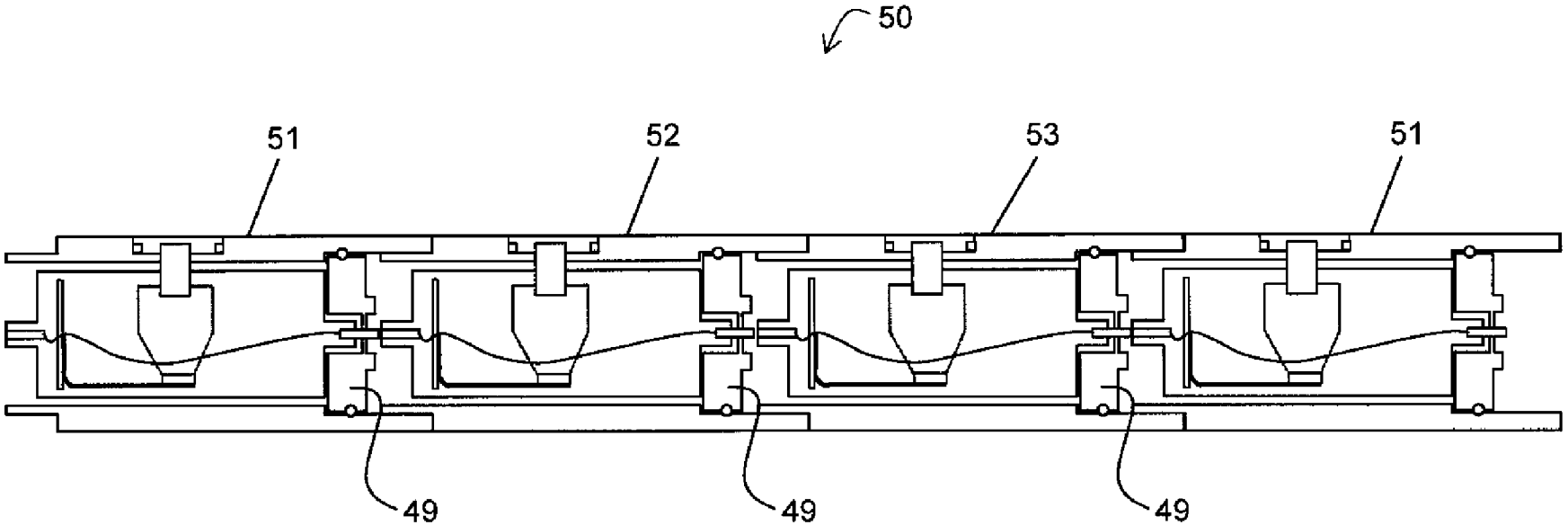
FIG. 5 is a pictorial diagram in partial cross-section of a perforating string composed of a plurality of single shot perforating guns as illustrated in FIG. 4.

With reference to FIG. 5, a perforating string 50 is illustrated which comprises a plurality of perforating guns 51-54 as described with respect to FIG. 4. A pressure bulkhead 49 is disposed between adjoining guns in the perforating string 50 for the same purposes or pressure bulkhead 16 in FIGS. 1-3.

Embodiments of the perforating gun of the present invention—as described above—include apparatuses, processes, and methods wherein a perforating gun is assembled at a first location that is not the site of perforating operations. The "first location" can actually comprise one location that is not the actual perforating site (i.e., at the well), or alternatively a combination of locations each of which are not the actual perforating site. For example, the initiator may be manufactured and installed into the loading tube at a shop in China, and then the loading tube may be transported to a shop in the United States where the detonating cord and shaped charges are installed and the loading tube is inserted into a carrier to form a perforating gun. One or more of the guns may be connected together to form a pre-assembled and pre-armed perforating gun string. Finally, the perforating gun string may be transported to the well site for deployment and detonation downhole.

What is claimed is:

1. A perforating gun apparatus for deployment at a well location, comprising:

a tubular carrier having a hollow interior bore;

an integrated loading tube for installation within the bore of the carrier, the loading tube comprising: (i) an RF-safe initiator receptacle, (ii) a wiring receptacle, (iii) a shaped charge receptacle, and a (iv) detonating cord receptacle;

an RF-safe initiator installed into the RF-safe initiator receptacle of the loading tube;

wiring installed into the wiring receptacle of the loading tube, the wiring operatively connected to the RF-safe initiator;

a shaped charge installed into the shaped charge receptacle of the loading tube; and a detonating cord installed into the detonating cord receptacle of the loading tube, the detonating cord operatively connecting the shaped charge to the RF-safe initiator, wherein the RF-safe initiator, wiring, shaped charge, and detonating cord are installed at a location other than the well location.

2. The perforating gun apparatus of claim 1, wherein the RF-safe initiator comprises an electronics board including an addressable switch, a fireset and an exploding foil initiator.

3. The perforating gun apparatus of claim 1, wherein the RF-safe initiator comprises an electronics board including an addressable switch, a fireset and an exploding bridge wire.

* * * * *